United States Patent [19]

Lee

[11] Patent Number: 4,914,824

[45] Date of Patent: Apr. 10, 1990

[54] PARALLEL RULE

[76] Inventor: Otis M. Lee, No. 96, Shou Tien Rd., Kang Shan Chen, Kao Hsiung Hsien, Taiwan, Taiwan

[21] Appl. No.: 347,194

[22] Filed: May 4, 1989

[51] Int. Cl.[4] ..... B43L 13/02

[52] U.S. Cl. ..... 33/449; 33/448

[58] Field of Search ..... 33/449, 448, 444, 450, 33/445, 447, 27.05

[56] References Cited

U.S. PATENT DOCUMENTS

| | | | |
|---|---|---|---|
| 51,609 | 12/1865 | Munson | 33/448 |
| 630,923 | 8/1899 | Palmer | 33/448 |
| 705,473 | 7/1902 | Sternfeld | 33/448 |
| 1,051,712 | 1/1913 | Eager | 33/449 |
| 1,267,665 | 5/1918 | Hindley | 33/449 |
| 1,276,955 | 8/1918 | Pidgeon | 33/449 |
| 2,112,069 | 3/1938 | Cooper | 33/449 |
| 2,234,467 | 3/1941 | De Lisle | 33/449 |
| 2,670,541 | 3/1954 | Preiss | 33/449 |
| 3,195,235 | 7/1965 | Regan | 33/449 |
| 3,462,846 | 8/1969 | Goerz | 33/449 |

FOREIGN PATENT DOCUMENTS

| | | | |
|---|---|---|---|
| 12186 | 8/1889 | United Kingdom | 33/449 |
| 179059 | 5/1922 | United Kingdom | 33/449 |

*Primary Examiner*—William A. Cuchlinski, Jr.
*Assistant Examiner*—Thomas B. Will
*Attorney, Agent, or Firm*—Connolly and Hutz

[57] ABSTRACT

A parallel rule including a rule body, a gripping attachment and two rolling devices which are installed at each end of the rule body. The rolling device has a cylindrical roller and a pair of anchorage portions extending from its end so that the roller is retractable. An opening is provided at each end of the rule body for the roller of the rolling device to project from. By use of the rolling device, the parallel rule is movable.

1 Claim, 4 Drawing Sheets

PARALLEL RULE

BACKGROUND OF THE INVENTION

The present invention relates to a parallel rule, and in particular relates to such a parallel rule having an improved rolling device to reduce the thickness of the rule body and adapted for facilitating drawing.

The parallel rule is an essential tool for a draftsman. Conventional parallel rules are generally constructed of a rule body 44, a plurality of positioning means 41 and 42 and a leading line 43, as shown in FIG. 6. By means of the leading line 43, the rule body is movable to draw horizontal lines. Generally speaking, the base of the rule body 44 contacts the drawing-paper so as to smear the ink or lead on the paper when the ink is not completely dry.

Therefore, those skilled in this art have found that a protrusion 51 slightly projecting from each distal end of the rule body 5 facilitates the movement of the rule body, as shown in FIG. 5. Unfortunately, such a construction is easily deformable after a long period of use. Further to this, another improved parallel rule, as shown in FIG. 4, has a plurality of beads 62 disposed under the rule body 6 to enable the rule body 6 to move conveniently. However, such a parallel rule also creates friction points during moving so as to smear ink or lead the paper. Moreover, the beads 62 make much noise when rolling.

Furthermore, another improved parallel rule is constructed as shown in FIG. 3, wherein the rule body 7 has a rolling mechanism 71 and a shaft 72 located therein for loading a roller 73 which is slightly projectable from the bottom of the rule body 7. By means of the roller 73, the rule body 7 is movable.

Such a construction widens the required thickness of the rule body 7 so as to maintain the rolling mechanism therein. Also, the construction of this type of parallel rule is rather complicated.

SUMMARY OF THE INVENTION

The present invention seeks to mitigate and/or obviate the above-mentioned drawbacks in the manner set forth in the detailed description of the preferred embodiment.

The primary objective of the present invention is to provide a parallel rule having a rolling mechanism to facilitate the movement of the parallel rule.

Another objective of the present invention is to provide a parallel rule has a reduced rule body thickness with respect to the prior art.

These and additional objects, if not set forth specifically herein, will be readily apparent to those skilled in the art from the detailed description provided hereinbelow, with appropriate reference to the accompanying drawings.

DETAILED DESCRIPTION OF THE PREFERRED EMBODIMENT

Figure 1:
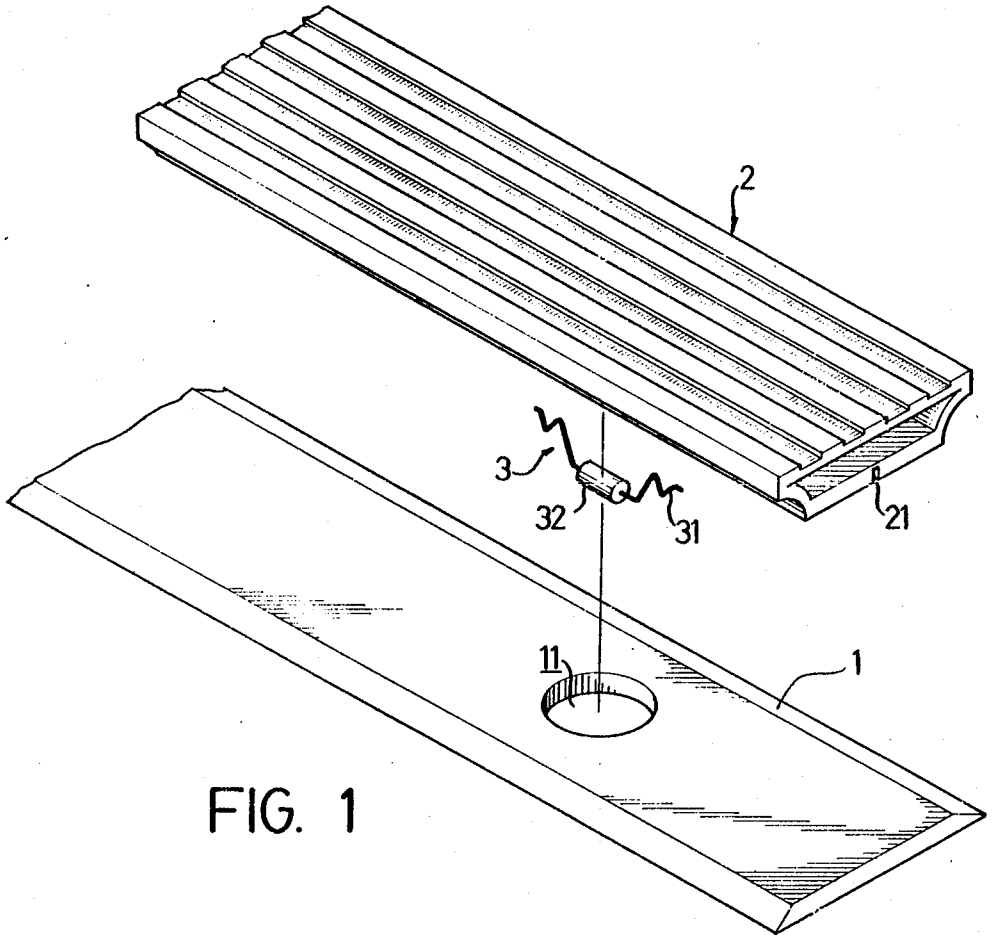
FIG. 1 is a partially cutaway exploded view of a parallel rule in accordance with the present invention.
Figure 6:
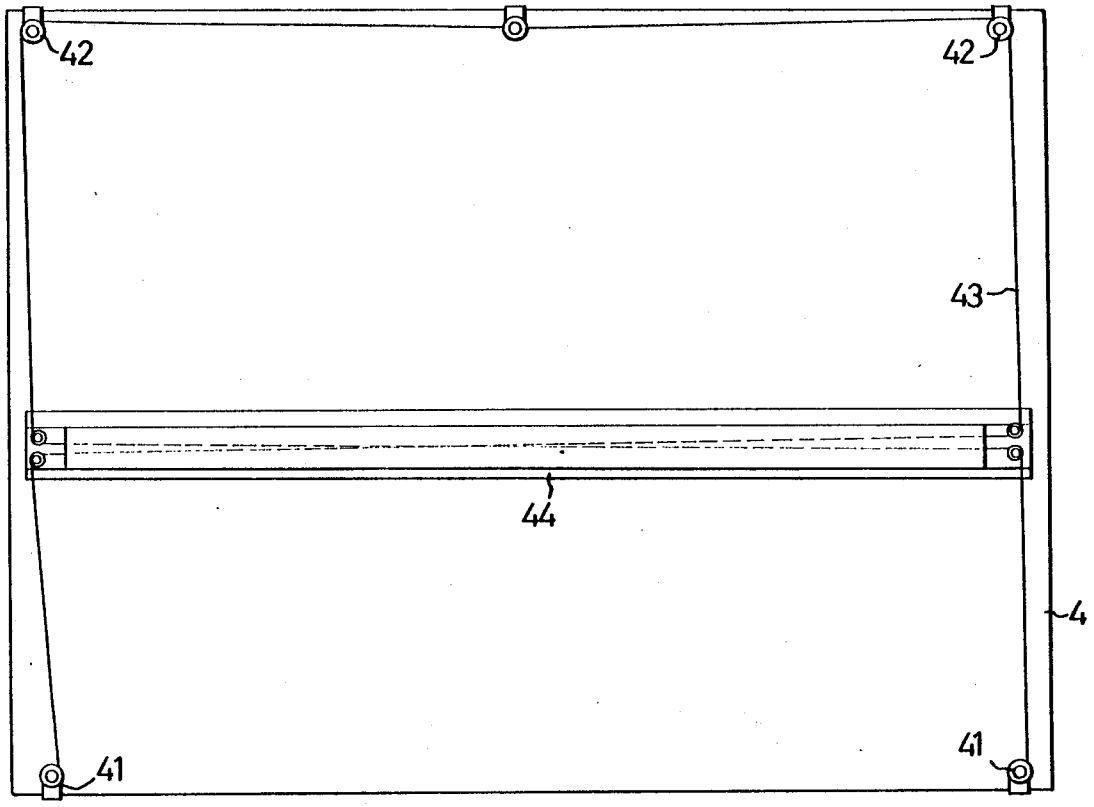
FIG. 6 PRIOR ART
FIG. 6 is a plan view of a fourth prior art.

With reference to FIG. 1, one end of a parallel rule in accordance with the present invention can be seen. The parallel rule comprises a rule body 1 having an opening 11 provided at each end thereof, a gripping means 2 attached to the top surface of the rule body 1 by means of double-sided tape and a rolling device 3 located within each opening 11. A working view of a prior art is seen in FIG. 6. The present invention has a similar arrangement of positioning means 41, 42 and leading line 43, but since these parts are not novel, per se, they will not be discussed further herein.

The rolling device 3 has a cylindrical roller 32 and a pair of anchorage portions 31 each connecting to a respective side of the cylindrical roller 32.

A groove 21 extends along a bottom surface of the gripping means 2 so as to receive the anchorage portions 31 therein. The diameters of the anchorage portions 31 are appropriately sized to the groove 21 to prevent the anchorage portions 31 from moving in the groove 21. Provided that the width and the depth of the groove are respectively about 1 mm and 2 mm, and the diameter of the anchorage portion 31 is approximately 1 mm, the same as the width of the groove 21, the anchorage portions 31 therefore are secured between the the groove 21 and the upper surface of the rule body.

Figure 2:
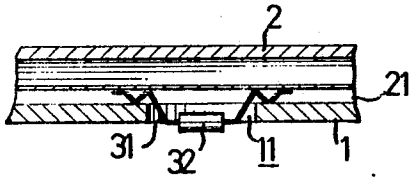
FIG. 2 is cutaway cross-sectional view showing of the rolling device of the parallel rule of FIG. 1.
Figure 3:
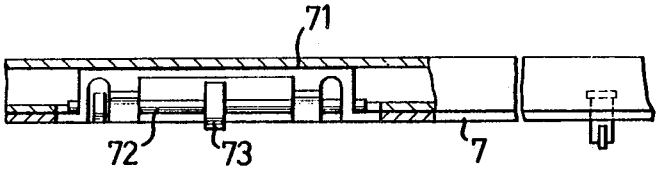
FIG. 3 PRIOR ART
FIG. 3 is a partially cutaway cross-sectional view of a first prior art.
Figure 4:
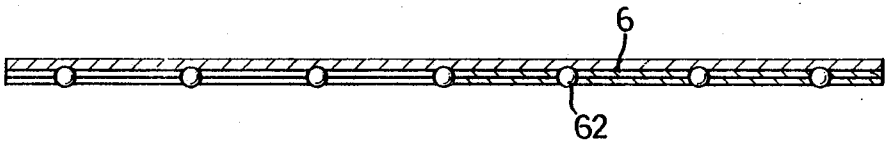
FIG. 4 PRIOR ART
FIG. 4 is a cross-sectional view of a second prior art.
Figure 5:
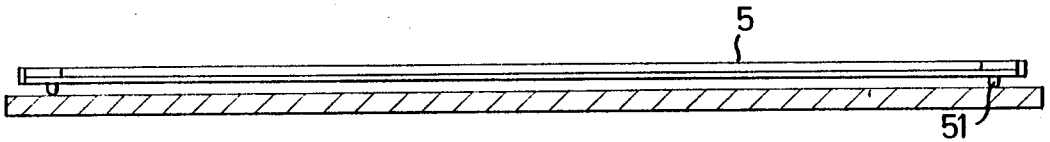
FIG. 5 PRIOR ART
FIG. 5 is a cross-sectional view of a third prior art.

As shown in FIG. 2, the cylindrical roller 32, having a diameter of approximately 3 mm, projects from a lower end of the opening 11 by means of the anchorage portions 31. In addition, the parallel rule is movable steadily. When pressing the gripping means 2, the cylindrical roller 32 retracts into the opening 11 due to the flexibility of the anchorage portions 31; that is to say, the rule body 1 can be pressed down to touch with the paper so as to facilitate drawing. Generally speaking, the thickness of the rule body 1 is approximately 3 mm thick, the same as the diameter of the cylindrical roller 32.

This type of parallel rule does not smear the paper when moving and there is no gap between the rule body 1 and the paper when drawing. In addition, the construction is very simple, so that the thickness of the parallel rule is reduced with respect to the prior art.

While the present invention has been explained in relation to its preferred embodiment, it is to be understood that various modifications thereof will be apparent to those skilled in the art upon reading this specification. Therefore, it is to be understood that the invention disclosed herein is intended to cover all such modifications as fall within the scope of the appended claims.

I claim:

1. A parallel rule comprising an elongated rule body having an opening provided at each end thereof, an elongated gripping means attached to a top surface of said rule body and a rolling device located within each opening;

each said rolling device having a cylindrical roller and a pair of anchorage portions, each inner section of said anchorage portion being rotatably connected to a respective side of said cylindrical roller;

a groove extending along a bottom surface of said gripping means so as to receive each of said anchorage portions therein, each respective outer section of said anchorage portions being secured by said groove and said top surface of said rule body, each said cylindrical roller projecting through said opening beyond a lower surface of said rule body.

* * * * *